US005644343A

United States Patent [19]

Allen

[11] Patent Number: 5,644,343

[45] Date of Patent: Jul. 1, 1997

[54] METHOD AND APPARATUS FOR MEASURING THE TEMPERATURE OF DROPS EJECTED BY AN INK JET PRINTHEAD

[75] Inventor: Ross R. Allen, Belmont, Calif.

[73] Assignee: Hewlett-Packard Company, Palo Alto, Calif.

[21] Appl. No.: 359,775

[22] Filed: Dec. 20, 1994

[51] Int. Cl.[6] ..... B41J 29/38

[52] U.S. Cl. ..... 347/17

[58] Field of Search ..... 347/14, 17, 19, 347/22, 29; 374/120, 135

[56] References Cited

FOREIGN PATENT DOCUMENTS

562786 A2 9/1993 European Pat. Off. ..... 347/17

58-217365 12/1983 Japan ..... 347/17

*Primary Examiner*—Benjamin R. Fuller

*Assistant Examiner*—Craig A. Hallacher

[57] ABSTRACT

The volume of ink drops ejected from ink jet printers is temperature dependent because physical properties of the ink, such as surface tension and viscosity, depend on the ink temperature. The volume of the ejected ink drop strongly influences the size of the printed spot and this size effects the quality of the recorded text and graphics. The temperature of the ejected drop depends on the temperature of the drop ejection mechanism. The present invention measures the temperature of the ejected drops with a temperature sensor placed within the trajectory of the drops. The printhead carriage mechanism aligns the drop ejector and the temperature sensor. Then, the drop ejector ejects multiple drops onto the temperature sensor. The temperature sensor may reside in an ink drop collection chamber having a capillary device for wicking ink away from the temperature sensor to a waste ink accumulator.

19 Claims, 4 Drawing Sheets

METHOD AND APPARATUS FOR MEASURING THE TEMPERATURE OF DROPS EJECTED BY AN INK JET PRINTHEAD

FIELD OF THE INVENTION

This invention relates generally to the field of ink jet printers and more particularly to the field of thermal management of ink jet printers.

BACKGROUND AND SUMMARY OF THE INVENTION

Ink jet printers have gained wide acceptance. These printers are described by W. J. Lloyd and H. T. Taub in "Ink Jet Devices," Chapter 13 of *Output Hardcopy Devices* (Ed. R. C. Durbeck and S. Sherr, Academic Press, San Diego, 1988) and by U.S. Pat. No. 4,490,728. Ink jet printers produce high quality print, are compact and portable, and print quickly but quietly because only ink strikes the paper. The major categories of ink jet printer technology include continuous ink jet, intermittent ink jet, and drop-on-demand ink jet. The drop-on-demand category can be further broken down into piezoelectric ink jet printers and thermal ink jet printers. Drop-on-demand ink jet printers produce drops by rapidly decreasing the volume of a small ink chamber to initiate a pressure wave that forces a single drop through the orifice. Capillary action causes the ink chamber to refill.

The typical ink jet printhead has an array of precisely formed orifices attached to an ink jet printhead substrate having an array of ink jet drop ejectors that receive liquid ink (i.e., colorants dissolved or dispersed in a solvent) from an ink reservoir. In thermal ink jet printheads, each ink jet drop ejector has a thin-film resistor, known as a heater, located near or opposite from the orifice so ink can collect between it and the orifice. When electric printing pulses drive the heater, a thin layer of ink near the surface of the heater vaporizes and propels a drop of ink from the printhead. In piezoelectric ink jet printheads, each ink jet drop ejector has a piezoelectric transducer located near or opposite from orifice so ink can collect between it and the orifice. When electric printing pulses drive the piezoelectric transducer, a volumetric or elongational change occurs within the piezoelectric material that is mechanically coupled to the drop ejector in such a manner as to eject a drop of ink from the orifice. Drop ejection orifices are arranged in an array, typically in one or more columns, to achieve the desired vertical printing resolution. Properly sequencing the operation of the ink jet drop ejectors causes characters or images to form on the recording medium as the printhead scans across it.

The volume of ink drops ejected from ink-jet printers is temperature dependent because physical properties of the ink, such as surface tension and viscosity, depend on the ink temperature. Additionally, the energy available for bubble nucleation in thermal ink jet drop ejectors depends on temperature. This factor further contributes to the variation of drop volume with temperature. The temperature of the drops ejected from piezoelectric and thermal ink jet printheads substantially equals the temperature of the drop ejectors because the thermal capacity of the drop ejectors greatly exceeds that of the ink contained in them and because the ink contained in them dwells within them long enough to become in substantial thermal equilibrium with them.

Print quality is particularly sensitive to variations in the ink drop volume because these variations cause the spot size on the recording medium to vary and thereby affect the darkness of black-and-white text, the contrast of gray-scale images, and the chroma, hue, and lightness of color images. The chroma, hue, and lightness of a printed color depend on the volume of each subtractive primary color drop, namely the volumes of cyan, magenta, yellow, and black ink drops. If the volume of the ejected drops increases or decreases while a page is printed, as would happen if the printhead substantially heats up during this process, the colors at the top of the page may not match the colors at the bottom of the page.

Ink jet drop ejectors must eject drops over a wide range of operating temperatures. A drop ejector that creates satisfactory print when it is at room temperature may eject drops that are too large when it becomes hot. The excessive ink degrades the print quality by causing: the printed spot size to grow, the bleeding of ink spots having different colors, and, potentially, the cockling and curling of the paper.

Another problem occurs when drop ejectors become very warm. The dissolved gases in the ink diffuse out and form gas bubbles in the drop ejectors that can cause the drop ejectors to deprime. For example, consider a simple thermal ink jet printhead with three drop ejectors sharing a common heat conducting substrate. If drop ejector "one" and drop ejector "three" are printing at 100% duty cycle (i.e., every pixel at the maximum drop ejection rate), some of the heat they produce will flow into the silicon substrate and heat it. This substrate conducts heat to drop ejector "two" placed between "one" and "three". In extreme situations, where "two" does not eject any drops and the ink remains in the drop ejector, dissolved gases in the ink may come out of solution and deprime drop ejector "two" as a result of heating by drop ejectors "one" and "three". Furthermore, at high temperatures, the physical properties of the ink and the energy produced by the vaporization of ink in a thermal ink jet printhead may change to the extent that print quality becomes unsatisfactory. Therefore, management of printhead temperature under various environmental conditions and printhead duty cycles is an objective in the design of a thermal ink jet printing system: If the printer controller could measure the temperature of the drop ejectors, it could compensate for high temperatures by reducing the energy in the firing pulses and/or reducing the print speed and thereby cause the drop ejector to eject drops of nearly constant volume.

Previously known techniques for measuring the temperature of an ink jet drop ejector employ discrete devices such as thermistors and thermocouples. These devices have several disadvantages: their installation on the printhead substrate requires additional manufacturing steps and their large size prevents them from being located near the ink jet drop ejectors. This remote installation introduces a time lag in thermal measurements and inaccuracies in transient temperature measurements.

Another previously known technique for measuring the average temperature of an ink jet drop ejector substrate employs a thermally sensitive resistor (TSR) formed in the conductor layer of the printhead substrate around the ink jet drop ejectors. One disadvantage of a TSR is that it adversely affects thin film production yields because achieving control limits on the nominal resistance and coefficient of resistivity requires the rejection of some devices. Another disadvantage is that the TSR measures the average temperature over the entire printhead substrate instead of the temperature of an individual ink drop ejector.

Further disadvantages of discrete temperature sensors and TSR's include the addition of analog devices to each printhead and the calibration they require that adds to the cost and complexity of the printer. After combining the tolerances of the various analog components with the limitations on accuracy mentioned earlier (e.g., the significant distance between the temperature sensors and the ink drop ejector and the measurement of the average temperature of the printhead substrate instead of the temperature of a particular ink drop ejector), the uncertainty of the temperature measurements maybe a significant fraction of the operating range of the printhead, This can result in ineffective printhead thermal management producing unnecessary constraints on throughput or inadequate control of print quality parameters.

For the reasons previously discussed, it would be advantageous to accurately and inexpensively measure the temperature of individual drop ejectors, so that the printer can minimize variations in the ejected drop volume.

The present invention is a method and apparatus for measuring the temperature of individual ink jet drop ejectors by measuring the temperature of their ejected drops. A printhead is positioned so that drops ejected from it strike a temperature sensor. The ink jet drop ejector ejects several hundred drops to the temperature sensor and it measures the temperature of these drops which thereby measures the temperature of the ink jet drop ejector. The temperature sensor has a low heat capacity that enables it to respond quickly to the temperature of the ejected ink drops. An ink drop collection chamber surrounds the temperature sensor and collects the ejected ink drops that cover the temperature sensor. Also, the present invention has a capillary bundle that wicks accumulated ink from the temperature sensor to a waste ink accumulator. The temperature sensor, ink drop collection chamber, capillary bundle, and waste ink accumulator can be part of a printhead service station (which performs capping, wiping, priming, and other functions) or a stand-alone component within the printer.

An advantage of the present invention is that it measures the temperature of each individual drop ejector during operation. This is important because the temperature of each individual ink jet drop ejector affects the volume of the ejected drops it produces and the consistency of this volume influences the quality of the recorded image.

Another advantage of the present invention is that it facilitates improved printhead thermal management. Once the temperature of each individual drop ejector is known, high temperatures can be reduced by slowing down the print speed, by printing with every other drop ejector, by not using a drop ejector that is too warm, by driving the drop ejector with lower energy pulses, and other means that reduce the amount of energy transmitted to that drop ejector until it cools down. Thus, the present invention allows better thermal management of individual drop ejectors.

Another advantage of the present invention is that it does not require the addition of hardware to the printhead substrate that reduces the production yields of the ink jet printhead chips and requires extra space on the ink jet printhead substrate. This feature makes the present invention inexpensive and simplifies its implementation into existing designs. Furthermore, this invention does not require separate analog electronics for each printhead substrate and a calibration procedure that requires a reference temperature measurement.

BRIEF DESCRIPTION OF THE DRAWINGS

FIG. 3A shows bubble nucleation, FIG. 3B shows bubble growth and drop ejection, and FIG. 3C shows refilling of the drop ejector.

DETAILED DESCRIPTION OF THE INVENTION

A person skilled in the art will readily appreciate the advantages and features of the disclosed invention after reading the following detailed description in conjunction with the drawings.

Figure 1:
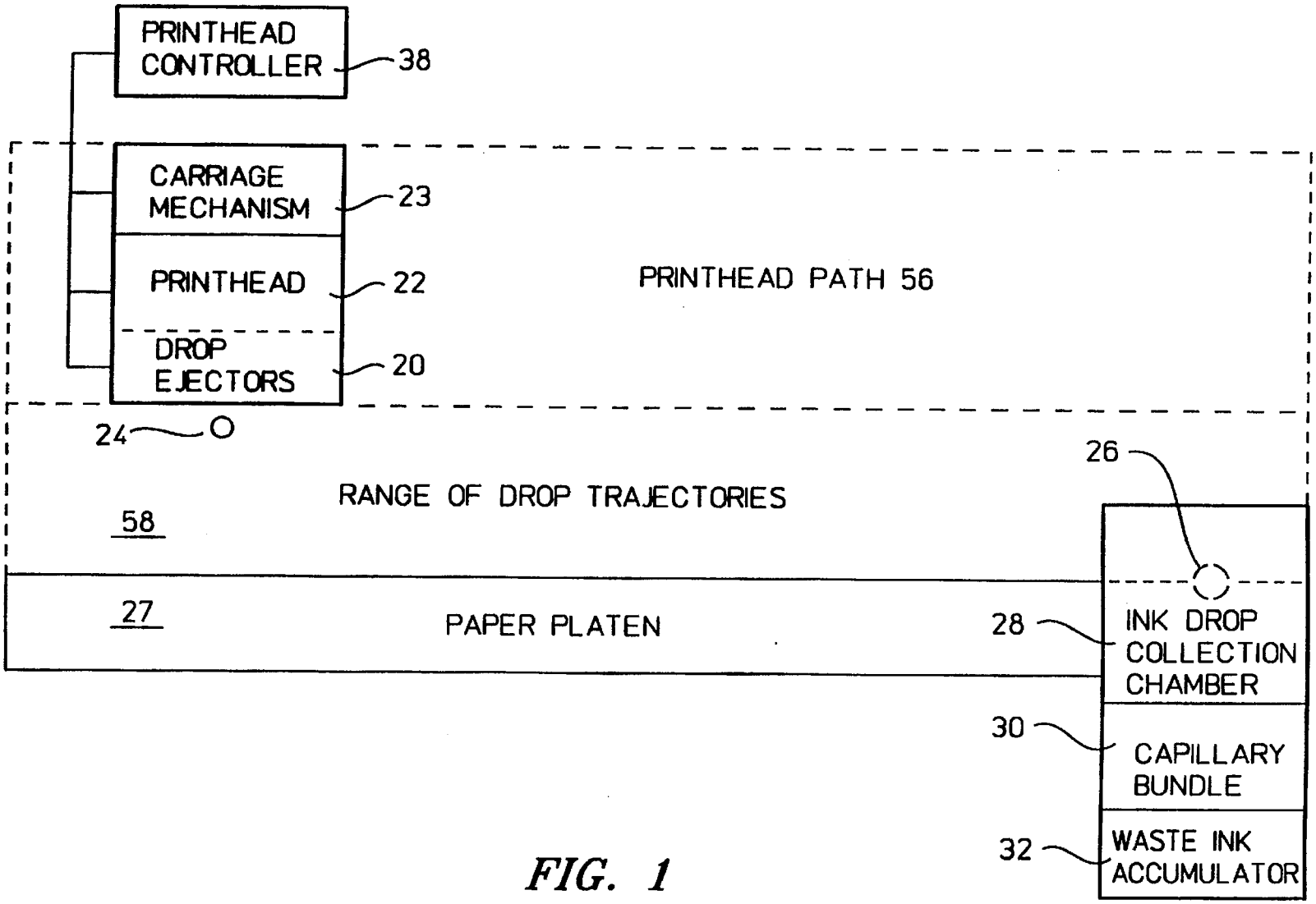
FIG. 1 is a schematic drawing of the apparatus for measuring the temperature of drops ejected from an ink jet drop ejector.

FIG. 1 is a schematic drawing of the present invention that measures the temperature of an ink jet drop ejector 20 by measuring the temperature of ejected drops 24. Carriage mechanism 23 responses to commands from printhead controller 38 by moving printhead 22 and its drop ejectors 20 across printhead path 56 marked by dotted lines. Drops ejected from drop ejector 20 travel within the range of drop trajectories 58 to a paper platen 27 or an ink drop collection chamber 28 depending on the position of printhead 22.

When printhead controller 38 measures the temperature of a drop ejector 20, it causes carriage mechanism 23 to align one of the drop ejectors 20 with a temperature sensor 26. Then, printhead controller 38 causes that drop ejector 20 to eject several hundred drops to temperature sensor 26. Temperature sensor 26 has a low heat capacity that enables it to respond quickly to the temperature of the ejected ink drops. In the preferred embodiment of the invention, temperature sensor 26 resides in an ink drop collection chamber 28. The ejected ink drops collect in this chamber and envelope temperature sensor 26. A capillary bundle 30 wicks accumulated ink away from temperature sensor 26 to a waste ink accumulator 32 where it is stored or until it evaporates. Measurement electronics 34 condition the output of temperature sensor 26 for processing by controller 38. The scope of the invention includes stand alone temperature sensors 26 that do not reside in an ink drop collection chamber 28.

Temperature sensor 26, ink drop collection chamber 28, capillary bundle 30, and waste ink accumulator 32 could be made part of a service station similar to those described in U.S. Pat. No. 4,853,717 entitled "Service Station For Ink-Jet Printer", invented by Harmon et al., and in U.S. Pat. No. 5,027,134 entitled "Nonclogging Cap and Service Station For Ink-Jet Printheads" invented by Harmon et al., both patents are assigned to the assignee of the present invention, and both are hereby incorporated by reference. There are many other types of service stations, such as that described in U.S. Pat. No. 5,155,497 entitled "Service Station For Ink-Jet Printer" invented by Martin et al., assigned to the assignee of this invention, and hereby incorporated by reference. The scope of the invention includes making the temperature sensor 26, ink drop collection chamber 28, capillary bundle 30, and waste ink accumulator 32 a part of any service station or a stand alone device.

Printhead controller 38, the printhead carriage, the carriage motor, the carriage mechanical hardware, the carriage servo electronics, the optical encoder, and other devices needed to align ink jet drop ejector 20 with temperature sensor 26 are well known in the art and described in *Development of a High-Resolution Thermal Inkjet Printhead,* Hewlett-Packard Journal, Oct. 1988, pp. 55–61; *Integrating the Printhead into the HP Desk Jet Printer,* Hewlett Packard Journal, Oct. 1988, pp. 62–66; *Desk Jet Printer Chassis and Mechanism Design,* Hewlett-Packard Journal, Oct. 1988, pp. 67–75; and *Economical, High-Performance Optical Encoders,* Hewlett-Packard Journal, Oct. 1988, pp. 99–106.

Figure 2:
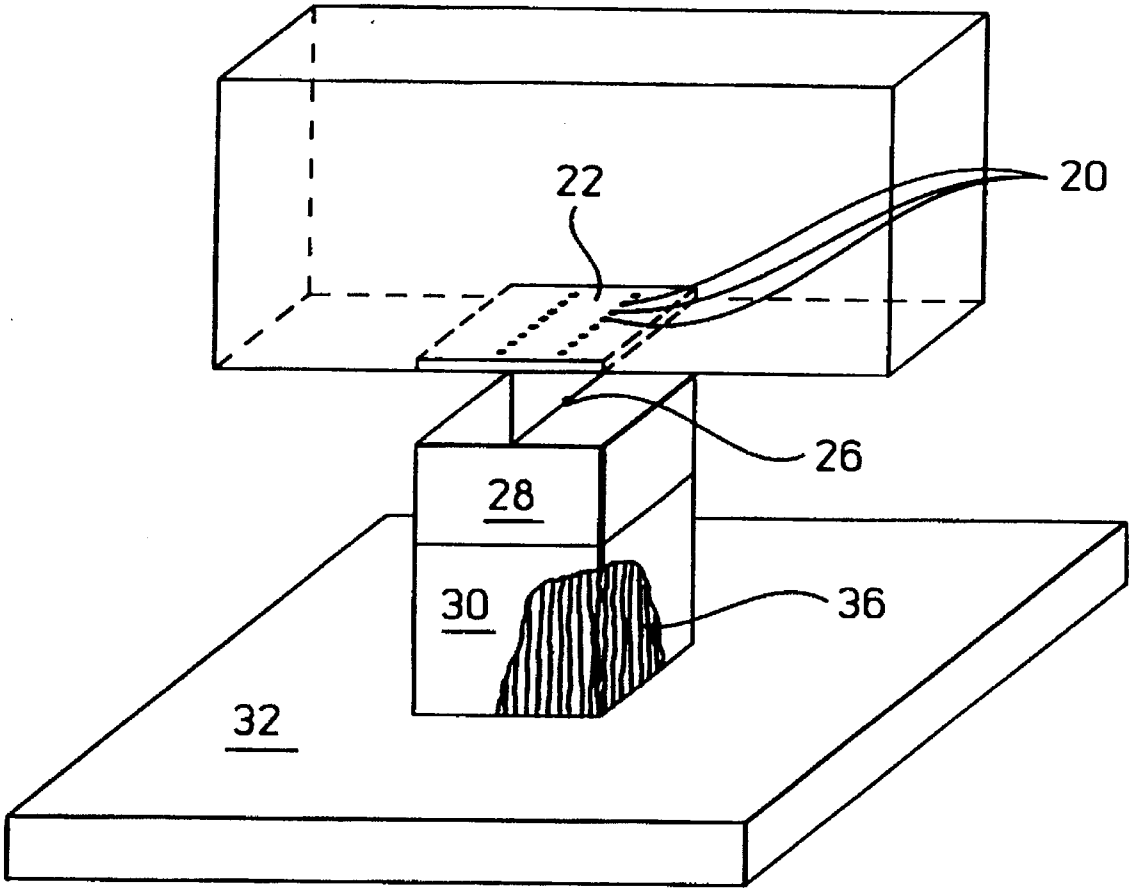
FIG. 2 shows the temperature sensor inside an ink drop collection chamber of FIG. 1, a capillary bundle for wicking ink away from the temperature sensor, and a waste ink accumulator.

FIG. 2 shows temperature sensor 26, ink drop collection chamber 28, capillary bundle 30, and waste ink accumulator 32 in more detail. The scope of the present invention includes printheads having an on-board ink supply 32, as shown in FIG. 2, as well as an off-board ink supply. As stated earlier, controller 38 positions printhead 22 over temperature sensor 26 and it ejects a burst of several hundred drops 24 onto temperature sensor 26. This process can be done while the printer is active, pausing for a fraction of a second outside the active printing area on a carriage return to measure the temperature of selected drop ejectors. Temperature sensor 26 must have low heat capacity to track the temperature of ejected drops 24 that have a volume of approximately 100 pL. The temperature of ejected drop 24 equals the temperature of drop ejector 20 since very little cooling occurs during the 100–200 microsecond flight. A capillary bundle 30 wicks ink from temperature sensor 26 to a waste ink accumulator 32 where the volatile components of ejected drop 24 evaporate.

Temperature sensor 26 could be a thermistor, thermocouple, KYNAR (a temperature sensitive, pyroelectric film made by DuPont), or any temperature sensitive device of low thermal capacity. The preferred embodiment of the invention uses an iron-constantin thermocouple with wires having a diameter of approximately 0.005" and a solder point having a diameter of approximately 0.010".

In the preferred embodiment, capillary bundle 30 is a bundle of fibrous material such as cellulose that has small spaces between the fibers so capillary forces draw ink from ink drop collection chamber 28 through capillary bundle 30 to waste ink accumulator 32. The shape of the fibers and the shape of capillaries 36 between the individual fibers controls the speed at which capillary bundle 30 can move the ink away from ink drop collection chamber 28 and into waste ink accumulator 32. Once the ink removal rate is known, then the appropriate fibrous material for capillary bundle 30 can be selected.

The desired ink removal rate of capillary bundle 30 is determined by: the rate at which ink drops are fired at temperature sensor 26, the depth of desired accumulation of drops in ink drop collection chamber 28, the length of time between measurement of the temperature of the different drop ejectors 20.

Another preferred embodiment of the invention includes temperature measurement devices that dispense with capillary bundle 30 altogether and have ink drop collection chamber 24 connected directly to waste ink accumulator 32. The scope of the invention includes ink drop collection chambers 34 of all lengths.

Waste ink accumulator 32 holds the ink until volatile components of the ink evaporates. Its function and materials may be identical to the ink accumulation device used in service stations to contain waste ink. In the preferred embodiment, it is a piece of open cell foam that distributes the ink throughout it.

Figure 3A:
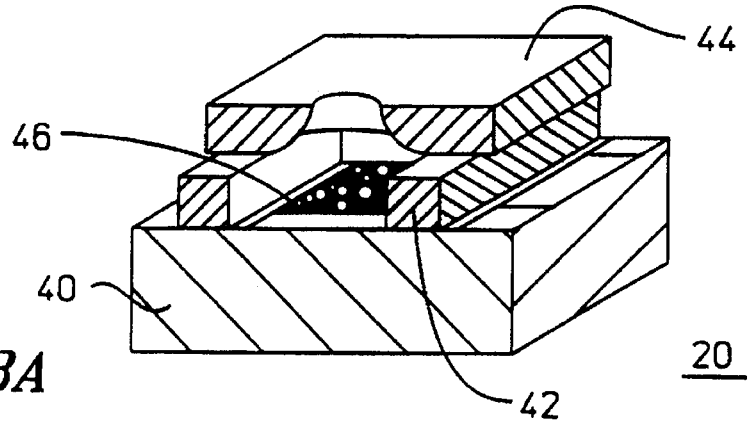
FIGS. 3A–3C show a cross section of an ink jet drop ejector and the drop ejection process.
Figure 3B:
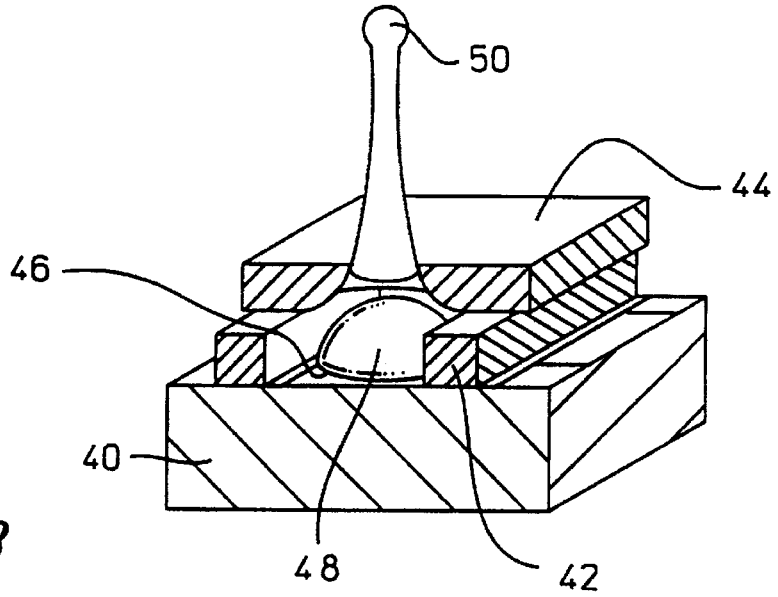
Figure 3C:
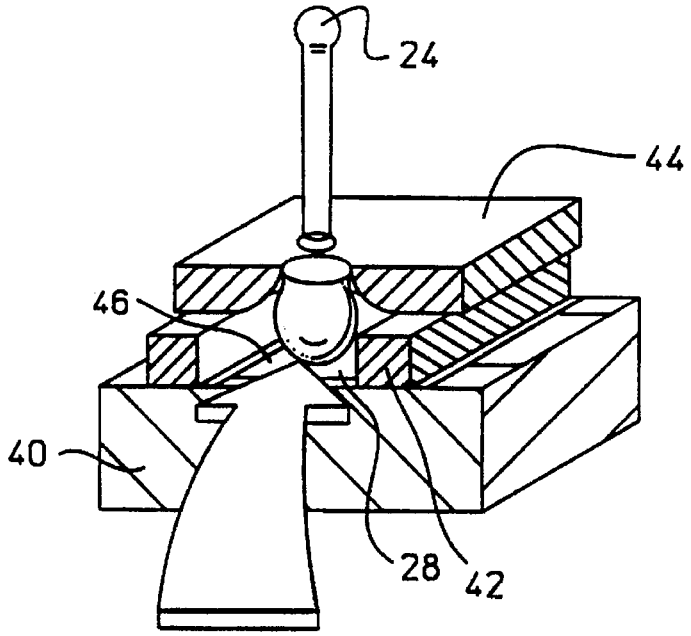

FIGS. 3A–3C show a cross section of an ink jet drop ejector, the drop ejection process, and why the temperature of ejected drops equals the temperature of the drop ejector. FIG. 3A shows bubble nucleation, FIG. 3B shows bubble growth and drop ejection, and FIG. 3C shows refilling of the drop ejector. A printhead substrate 40 is formed from a silicon wafer commonly used in integrated circuit fabrication. This substrate is a good conductor of heat. A barrier layer 42 is placed on top of printhead substrate 40 that, along with orifice plate 44, defines the drop ejector. Barrier layer 42 has a typical thickness of 0.001 inch and is a polymer within which the walls of drop ejection chamber 24 are photolithographically defined. Barrier layer 42 is not a good heat conductor. Inside drop ejector 20 is a heater 46 that remains idle except for about 3 to 5 microseconds out of a 200 millisecond or longer interval. This longer interval is the period between drop ejections. Depending on design, for 3–5 microseconds, electrical current flows through heater 46. It rapidly heats a thin layer of ink directly above its surface to about 350 degrees C (for water-based inks), this results in a superheated vapor explosion that creates a vapor bubble 48 in the ink, as shown FIG. 3B, that rapidly expands and produces a velocity field in the ink that expels a drop of ink 50 from drop ejector 20 to form ejected drop 24, shown in FIG. 3C. The electrical current is removed from heater 46 shortly after the formation of vapor bubble 48, but the vapor bubble continues to grow as a result of the velocity field in the ink. Approximately 10–20 microseconds after its formation, vapor bubble 48 collapses.

During the collapse of vapor bubble 48, ink drop 24 breaks off and air is drawn through drop ejection orifice 45 forming a meniscus within the orifice, as shown in FIG. 3C. The curvature of this meniscus produces a subatmospheric pressure within drop ejection chamber 28 that draws in fresh ink from the ink supply reservoir. For about 200 milliseconds, drop ejection chamber 28 refills and the meniscus in the orifice settles. During the heating phase and until vapor bubble 48 collapses, printhead substrate 40 absorbs heat from heater 46 and this heat flows to the ink in drop ejector 20 during the 200 millisecond (or longer interval) between firing pulses so that the temperature of the ink in drop ejector 20 equals the temperature of printhead substrate 40 in the vicinity of drop ejector 20. The layer of ink that is heated by heating resistor 46 during bubble formation is on the order of a micrometer thick. Upon bubble collapse, the surface of heater 46 is still above the average temperature in ink drop ejection chamber 28, but that heat is quickly transmitted to the ink and that ink mixes with fresh ink drawn into the chamber during the 200 millisecond refill, shown in FIG. 3C. The refill process effectively circulates the ink within drop ejection chamber 28 bringing the ink and local substrate 40 close to thermal equilibrium. Thus, the temperature of the ejected ink drop 24 remains at the temperature of printhead substrate 40 near that particular drop ejector 20 immediately before another pulse drives heater 46. This temperature is the temperature of the drop ejector and temperature sensor 26 measures it.

Silicon printhead substrate 40 absorbs heat from heater 46 and since it is a good conductor of heat it will tend to distribute this heat throughout the printhead substrate and, generally, the entire printhead substrate will have the same temperature if drop ejectors 20 have approximately the same firing rate. However, if the printer uses some drop ejectors 20 much more frequently than others, the temperature of printhead substrate 40 around those drop ejectors gets much hotter than other parts of printhead substrate 40. For example, if only drop ejectors on the top of printhead 22 eject drops, then the portion of printhead substrate 40 near these drop ejectors will be much hotter than the portion of the printhead substrate at the bottom of printhead 22. In typical thermal ink jet printheads, a temperature difference of 20° or more has been observed between groups of active and inactive drop ejectors. This is caused by the long heat conduction pathway between ends of the orifice columns and the good but not excellent heat conduction property of silicon.

Figure 4:
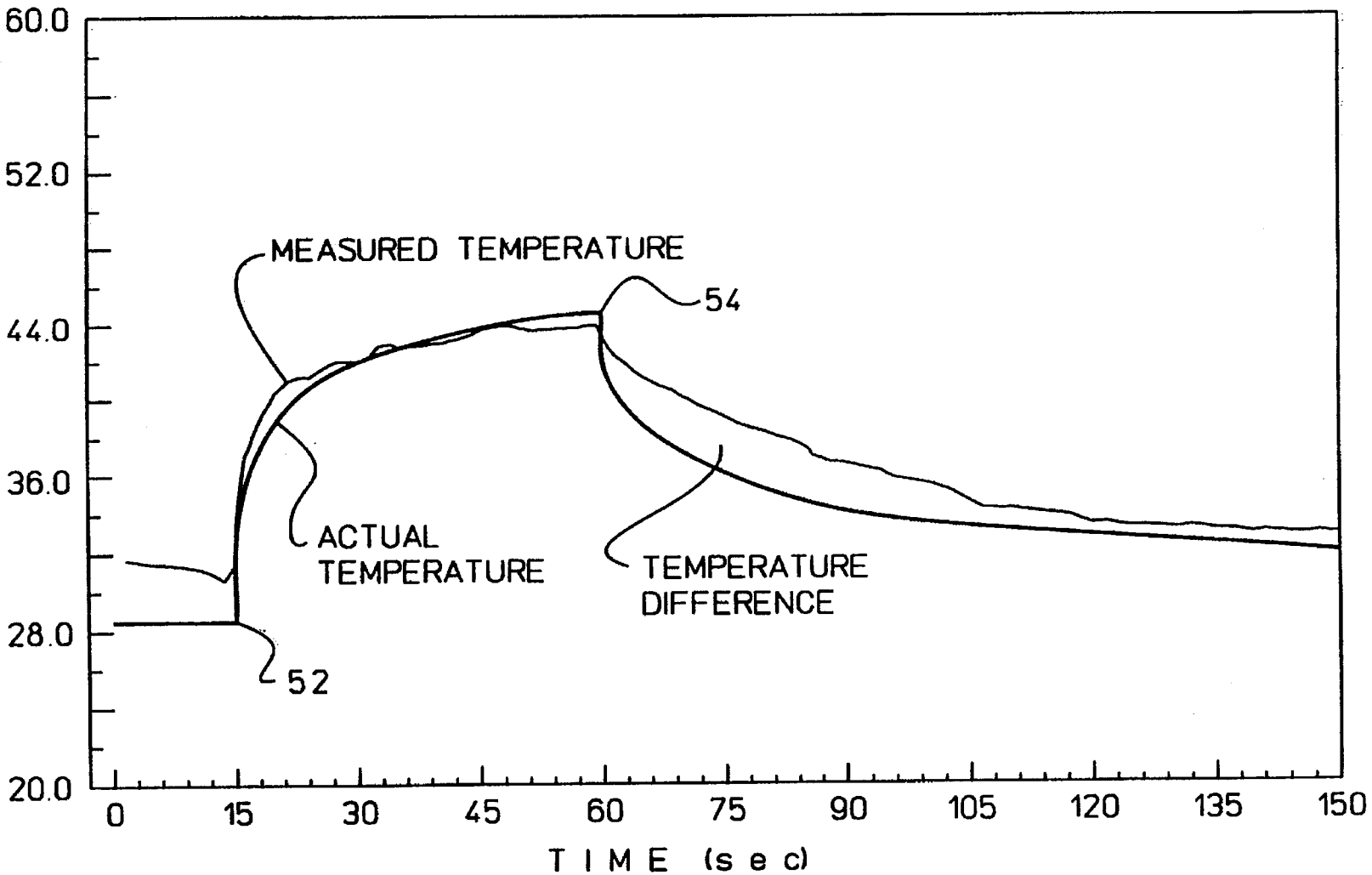
FIG. 4 compares the temperature of an ink drop as measured by the present invention with the actual temperature of the ink jet drop ejector.

FIG. 4 shows the actual temperature of a drop ejector, measured by a temperature sensing resistor on the printhead substrate near the drop ejector, and the temperature of ejected drops, as measured by the present invention. These are seen to track very closely after the printhead turns-on, at point 52, and before it turns-off at point 54. The temperature begins to diverge after point 52 when the printhead is turned-off because ink accumulates around temperature sensor 26. Between point 52, when the printhead turns-on, and point 54, where the printhead turns-off, the drop ejector ejects tens of thousands of drops. Temperature sensor 26 cannot detect the temperature of a single ejected drop 24 because of the small heat capacity of individual drops compared with that of the sensor. Drop ejector 20 must eject thousands of drops 24.

The present invention has the advantage that it is self-calibrating when used to measure relative temperatures. With a TSR, the calibrating procedure for measuring relative temperatures includes: determining the resistance by either counting squares or measuring the resistance of the TSR and then measuring the temperature coefficient of resistivity of the TSR. Both of these are variables in the manufacturing process which includes the deposition and etching of thin films on the silicon substrate.

All publications and patent applications cited in the specification are herein incorporated by reference as if each publication or patent application were specifically and individually indicated to be incorporated by reference.

The foregoing description of the preferred embodiment of the present invention has been presented for the purposes of illustration and description. It is not intended to be exhaustive nor to limit the invention to the precise form disclosed. Obviously many modifications and variations are possible in light of the above teachings. The embodiments were chosen in order to best explain the best mode of the invention. Thus, it is intended that the scope of the invention to be defined by the claims appended hereto.

What is claimed is:

1. An apparatus for monitoring thermal-inkjet elector temperature, for control of thermal-inkjet print quality, by measuring the temperature of drops ejected by thermal-inkjet printhead; said apparatus comprising:

a drop ejector on the thermal-inkjet printhead for ejecting drops to form printed images, said ejector having temperature-dependent print-quality characteristics; and means for monitoring the ejector temperature for control of said print-quality characteristics, said monitoring means comprising:

temperature sensor means for measuring the temperature of the drops;

means for aligning the drop ejector and the temperature sensor; and means for causing the drop ejector to eject multiple drops onto the temperature sensor means.

2. An apparatus, as in claim 1, wherein:

the ejected drops have a trajectory;

the means for aligning further comprise a means for placing the temperature sensor in the trajectory of the drops; and further comprising a capillary bundle having a first end located near the temperature sensor and a second end located near a waste ink accumulator.

3. An apparatus, as in claim 1, further comprising:

an ink drop collection chamber enclosing the temperature sensor; and wherein the means for aligning the drop ejector and the temperature sensor align the drop ejector with the ink drop collection chamber.

4. An apparatus, as in claim 3, further comprising: a capillary bundle having one end located near the temperature sensor and a second end located near a waste ink accumulator.

5. An apparatus, as in claim 4, wherein the means for aligning the drop ejector and the temperature sensor place the temperature sensor in the trajectory of the drops.

6. An apparatus, as in claim 1, wherein the temperature sensor has a low heat capacity.

7. The apparatus of claim 1, wherein:

the printhead has multiple said drop ejectors;

the causing means operate each of the multiple said ejectors independently; and the monitoring means monitor the temperature of each ejector for control of said print-quality characteristics of each ejector.

8. An apparatus for monitoring and controlling thermal-inkjet ejector temperature, for control of thermal-inkjet print quality, by measuring the temperature of drops ejected from a thermal-inkjet printhead; said apparatus comprising:

a drop ejector on the thermal-inkjet printhead for ejecting drops along a trajectory to form printed images, said ejector having temperature-dependent print-quality characteristics;

a temperature sensor positioned within a range of drop trajectories, the temperature sensor producing an output signal in response to a sensed temperature;

means for moving the printhead to align the trajectory of the drops with the temperature sensor;

drop ejector controller means for driving the drop ejector to eject drops, the drops striking the temperature sensor and the temperature sensor producing the output signal in response to the temperature of the drops; and means, responsive to the output signal, for controlling the ejector temperature during printing and thereby said print quality.

9. An apparatus, as in claim 8, further comprising: a capillary bundle having a first end located near the temperature sensor and a second end located near a waste ink accumulator.

10. An apparatus, as in claim 8, further comprising: an ink drop collection chamber located in the trajectory of the ejected drops, the temperature sensor resides inside the ink drop collection chamber.

11. An apparatus, as in claim 10, further comprising: a capillary bundle having one end located near the temperature sensor and a second end located near a waste ink accumulator.

12. An apparatus, as in claim 7, wherein the temperature sensor has a low heat capacity.

13. The apparatus of claim 8, wherein:

the printhead has multiple said drop ejectors;

the controller means drive each of the multiple said ejectors independently; and the temperature-controlling means control the temperature of each ejector substantially independently, for control of said print-quality characteristics for each ejector substantially independently.

14. A method for monitoring and controlling the temperature of drops ejected by a drop ejector in a thermal-inkjet printhead, comprising the steps of:

aligning the drop ejector with a temperature sensor so that the temperature sensor is in a trajectory of the drops;

striking the temperature sensor with the drops ejected from the drop ejector;

measuring the temperature of the ink drops; and in response to the measured temperature, controlling the printhead temperature.

15. A method, as in claim 14, further comprising the step of:

ejecting ink drops until an output temperature of the temperature sensor reaches an equilibrium value.

16. A method, as in claim 14, further comprising the step of:

wicking ink away from the temperature sensor.

17. A method, as in claim 14, wherein the steps aligning the drop ejector with a temperature sensor and striking the temperature sensor are replaced with the steps:

aligning the drop ejector with an ink drop collection chamber that the temperature sensor resides in; and ejecting drops into the ink drop collection chamber until the drops cover the temperature sensor.

18. A method, as in claim 17, further comprising the step of:

wicking ink away from the temperature sensor.

19. The method of claim 14, particularly for use with such a thermal-inkjet printhead which has multiple said drop ejectors, and wherein:

the striking step strikes the sensor with drops ejected from each of the multiple said ejectors, substantially independently; and the temperature-controlling step controls the temperature of each ejector substantially independently.

* * * * *